US009463130B2

(12) United States Patent
Wray

(10) Patent No.: US 9,463,130 B2
(45) Date of Patent: Oct. 11, 2016

(54) CASKET CORNER ATTACHMENT MECHANISM

(71) Applicant: Batesville Services, Inc., Batesville, IN (US)

(72) Inventor: Gregory Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 14/656,069

(22) Filed: Mar. 12, 2015

(65) Prior Publication Data

US 2015/0257961 A1 Sep. 17, 2015

Related U.S. Application Data

(60) Provisional application No. 61/952,607, filed on Mar. 13, 2014.

(51) Int. Cl.
*A61G 17/04* (2006.01)

(52) U.S. Cl.
CPC ..... *A61G 17/04* (2013.01)

(58) Field of Classification Search
CPC .... A61G 17/00; A61G 17/04; E04F 19/0436
USPC ..... 27/2, 10; 52/287.1, 288.1; D99/13
See application file for complete search history.

(56) References Cited

U.S. PATENT DOCUMENTS 2,330,141 A 9/1943 Olson
3,204,286 A 9/1965 Hillenbrand
4,615,085 A 10/1986 Hartman
5,144,727 A 9/1992 Craft
5,241,729 A 9/1993 MacKirdy
5,335,402 A 8/1994 Semon
5,604,965 A 2/1997 Shaw et al.
5,898,980 A 5/1999 Havranek et al.
6,138,335 A * 10/2000 Drawbaugh ..... A61G 17/04 27/10
6,317,945 B1 * 11/2001 Laphan ..... A61G 17/04 27/10
6,543,103 B1 * 4/2003 Robert ..... A61G 17/00 27/10
2014/0041170 A1 * 2/2014 Bovard ..... A61G 17/04 27/14
2015/0107068 A1 4/2015 Drew et al.

OTHER PUBLICATIONS

Gregory W. Wray, U.S. Appl. No. 14/710,085 filed May 12, 2015 entitled Decorative Hardware for Stationary Bar Caskets.
Travis Drew et al., U.S. Appl. No. 14/453,132 filed Aug. 6, 2014 entitled Casket Hardware Attachment Structure.

* cited by examiner

*Primary Examiner* — William Miller
(74) *Attorney, Agent, or Firm* — Wood, Herron & Evans, LLP

(57) ABSTRACT

A casket comprises a casket shell adapted to receive a deceased, a casket lid closeable on the shell, a casket ornament, and an attachment mechanism. The attachment mechanism has a first portion mounted to a corner of the shell and a second portion mounted to the casket ornament. The first and second portions resiliently cooperate to operably removably attach the casket ornament to the casket shell corner.

14 Claims, 6 Drawing Sheets

CASKET CORNER ATTACHMENT MECHANISM

RELATED APPLICATIONS

This application claims the priority benefit of U.S. Provisional Patent Application No. 61/952,607 filed Mar. 13, 2014, which is hereby incorporated by reference herein as if fully set forth in its entirety.

FIELD OF THE INVENTION

This invention relates generally to caskets, and more particularly to ornaments for caskets.

BACKGROUND OF THE INVENTION

There is a trend in the death care industry towards personalizing to the deceased the funeral products and the funeral or other memorial service to provide a more meaningful memorial experience for the family and friends of the deceased. The casket in which the deceased is displayed can be customized to fit the needs and preferences of the deceased and the family. For instance, a wide variety of materials, finishes, colors, and decorative ornamentation can be chosen for the casket.

Some casket designs incorporate decorative or ornamental corner pieces or ornaments secured to the casket during fabrication thereof. In many, if not most, prior designs, these ornamental corner pieces are rigidly affixed to the casket shell. Consequently, if a customer purchasing the casket is not pleased with the particular pre-installed ornamental corner pieces, and wishes to customize the casket exterior to his or her taste, the funeral director must go through a lengthy and complicated process to first remove the original ornamental corner pieces and then reinstall the ornamental corner pieces chosen by the customer. This process typically requires manual manipulation and access to the interior of the casket which may require the removal of bedding, lining, and the like. Such a process is time consuming and can damage the otherwise new casket and is thus frowned upon and generally avoided by the funeral director.

To more effectively market caskets, the funeral director desires to offer a wide variety of ornamental corner pieces from which a customer can select according to the customer's taste. However, to offer such a wide selection, and to avoid the undesirable practice mentioned above, the funeral director would have to maintain a large inventory of many different casket material/finish and corner piece combinations, which is also undesirable. To minimize the required inventory of finished caskets, the funeral director could simply have one casket of each material/finish provided that the funeral director had some means providing for the quick and efficient changing of the ornamental corner pieces on each casket. As such, the customer could quickly view numerous corner pieces on a single casket, and the funeral director would need only stock a single casket of each material/finish. Prior casket designs, which rigidly affix the ornamental corner pieces, do not permit such quick and efficient changing of the ornamental corner pieces as discussed above.

In response to this need, the assignee devised attachment mechanisms to permit the quick and efficient installation and removal of ornamental corner pieces onto and from caskets. Examples of such mechanisms are disclosed in the assignee's U.S. Pat. No. 7,591,052 for Quick Change Casket Ornament Attachment Mechanism, U.S. Pat. No. 7,340,810 for Quick Change Casket Corner Attachment Mechanism, U.S. Pat. No. 6,928,706 for Quick Change Casket Corner Attachment Mechanism, and U.S. Pat. No. 6,591,466 for Quick Change Casket Corner Attachment Mechanism, all of which are hereby incorporated by reference herein as if fully set forth in their entirety.

The above noted attachment mechanisms thus allow ready interchangeability amongst casket ornaments, thereby providing a casket purchaser with a degree of personalization. Notwithstanding the assignee's innovations in this area, further advancements are desired.

SUMMARY OF THE INVENTION

In one aspect, a casket comprises a casket shell adapted to receive a deceased, a casket lid closeable on the shell, a casket ornament, and an attachment mechanism. The attachment mechanism has a first portion mounted to a corner of the shell and a second portion mounted to the casket ornament. The first and second portions resiliently cooperate to operably removably attach the casket ornament to the casket shell corner.

The attachment mechanism first portion can comprise a pair of legs oriented at about a 90 degree angle relative to one another, each of the pair of legs attached to a respective one of a side wall and an end wall of the casket shell, and a pair of generally vertically oriented side walls each of which is associated with a respective one of the legs, each side wall and respective one of the legs oriented at about a 135 degree angle relative to one another, and each side wall including a generally vertically oriented rib thereon. The attachment mechanism second portion can comprise a pair of generally vertically oriented side walls each of which includes a generally vertically oriented slot therein. The pair of attachment mechanism second portion side walls can resiliently cooperate with the pair of attachment mechanism first portion side walls such that the ribs are received in the slots.

The attachment mechanism first portion can include a pair of vertically spaced apart vertical locators preventing vertical movement of the attachment mechanism second portion beyond a predetermined amount. The attachment mechanism first portion can also include a horizontal locator horizontally spaced apart from one of the side walls of attachment mechanism first portion, the horizontal locator and the one side wall preventing horizontal movement of the attachment mechanism second portion beyond a predetermined amount. In a preferred embodiment, each side wall of the attachment mechanism first portion includes a pair of the vertically spaced apart vertical locators, and each side wall of the attachment mechanism first portion includes a pair of vertically spaced apart horizontal locators. Each upper edge and lower edge of each side wall of the attachment mechanism second portion can include a notch therein receiving a respective one of the vertically spaced apart vertical locators.

The side walls of the attachment mechanism first portion can be connected with a front wall. The side walls of the attachment mechanism second portion can be cantilevered from a front wall of the casket ornament, and each of the side walls of the attachment mechanism second portion can further be connected to the front wall of the casket ornament with a pair of vertically spaced apart gussets. In a preferred embodiment, the upper gusset of each pair of gussets can be positioned above an upper end of a respective one of the generally vertically oriented slots and a lower gusset of each pair of gussets can be positioned below a lower end of a respective one of the generally vertically oriented slots.

The first and second portions of the attachment mechanism can be preferably molded from plastic. Further, the casket ornament and attachment mechanism second portion can be integrally molded from plastic. The legs of the attachment mechanism first portion can be fastened to the casket shell side and end walls with plastic Christmas tree fasteners. The casket can be fabricated from either wood or metal.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
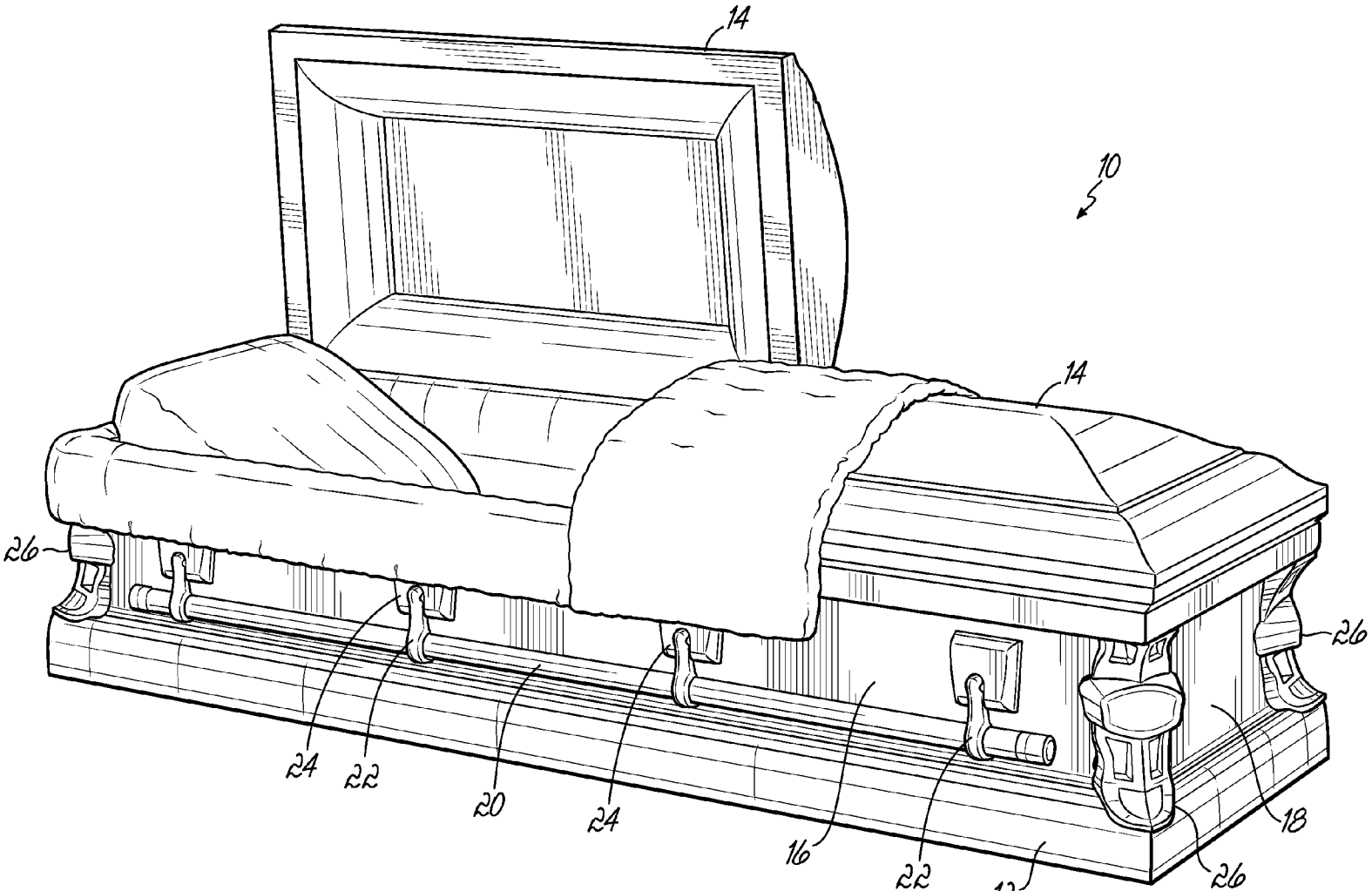
FIG. 1 is a perspective view of a casket and ornamental corner according to the principles of the present invention.
Figure 2:
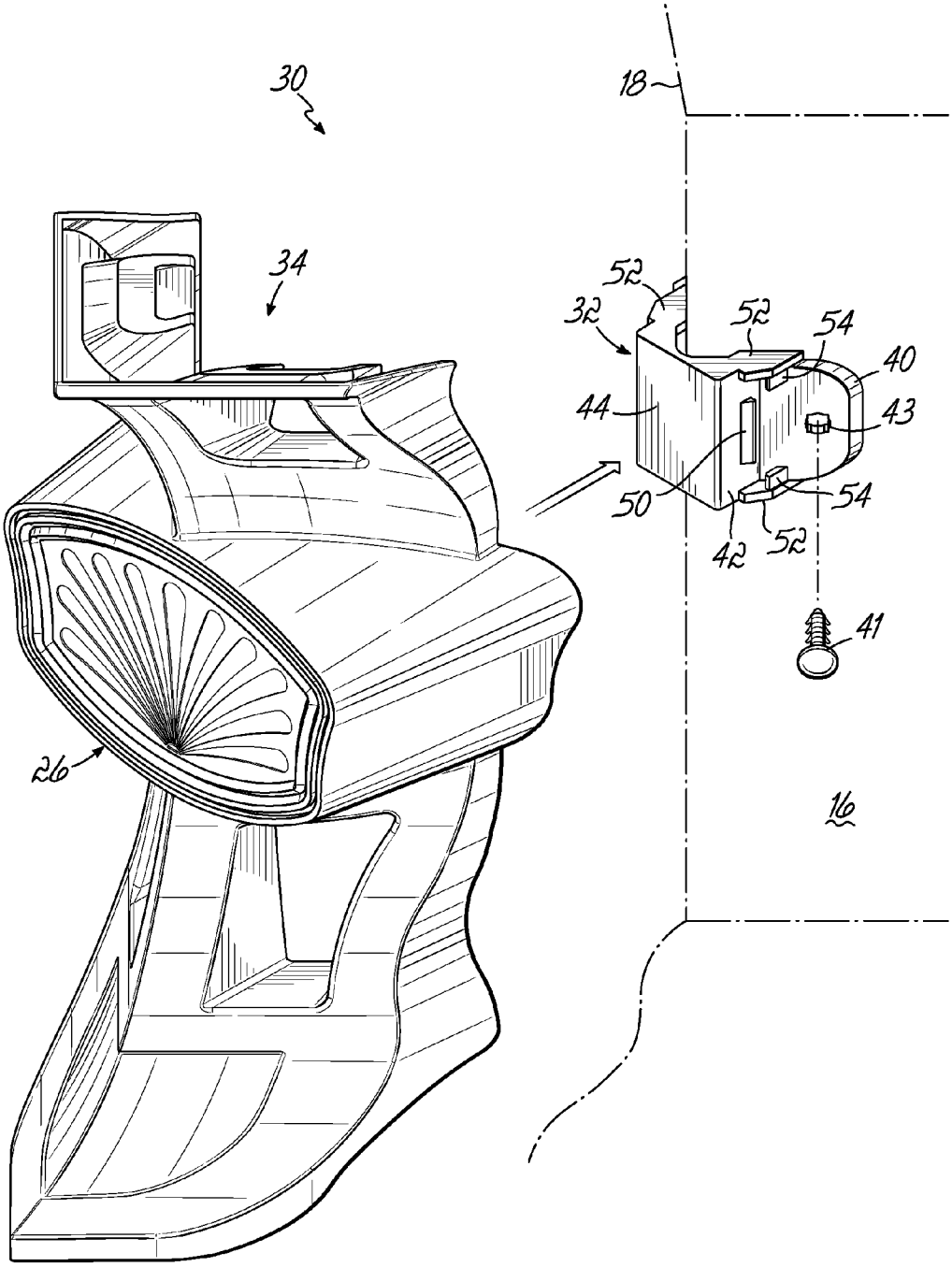
FIG. 2 is an enlarged, disassembled, front perspective view of one corner of the casket shell of FIG. 1 illustrating the ornamental corner and its associated attachment structure.
Figure 3:
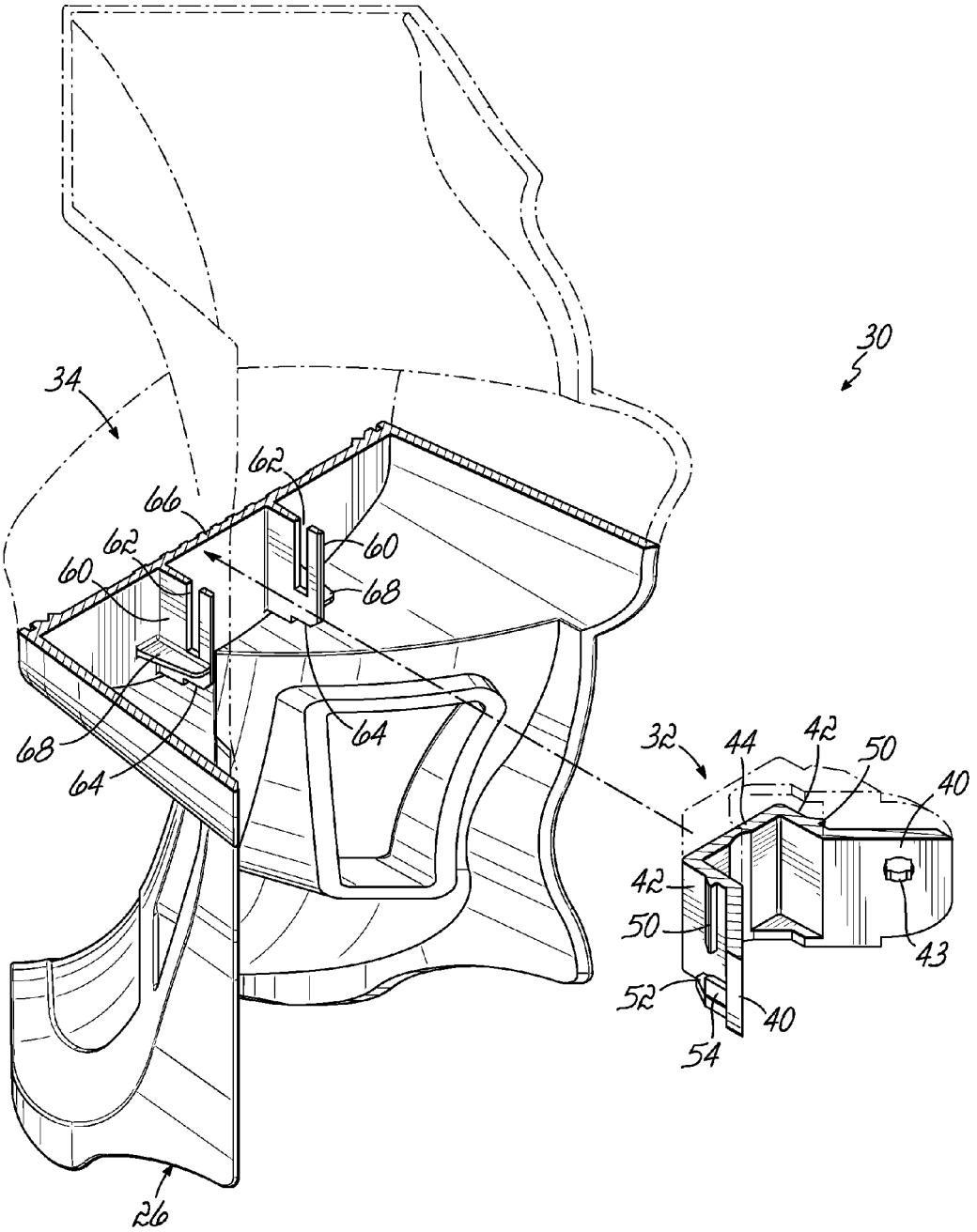
FIG. 3 is a partial rear perspective view of the ornamental corner and attachment structure of FIG. 2.
Figure 4A:
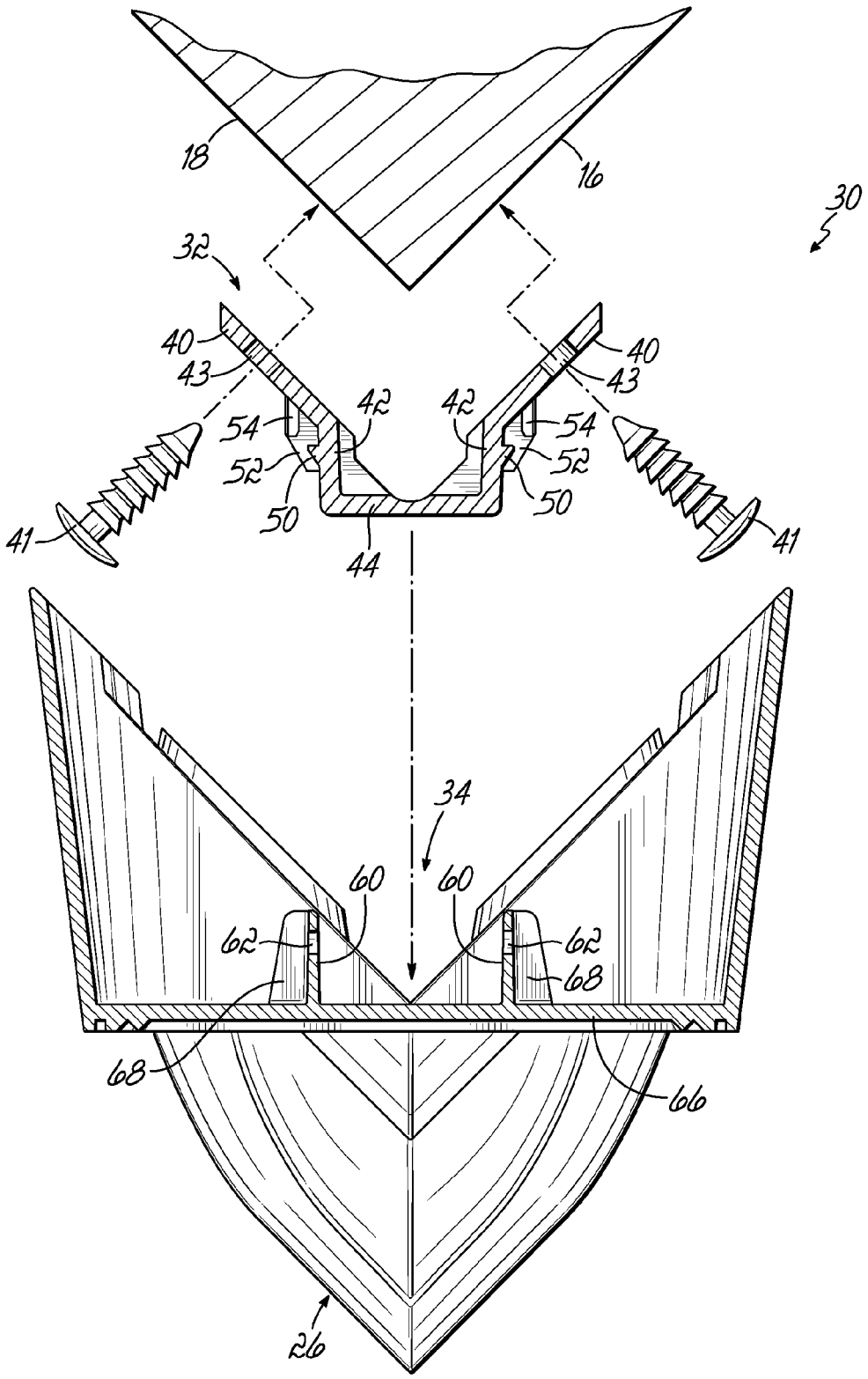
FIG. 4A is a top view of the ornamental corner and attachment structure of FIGS. 2 and 3.
Figure 4B:
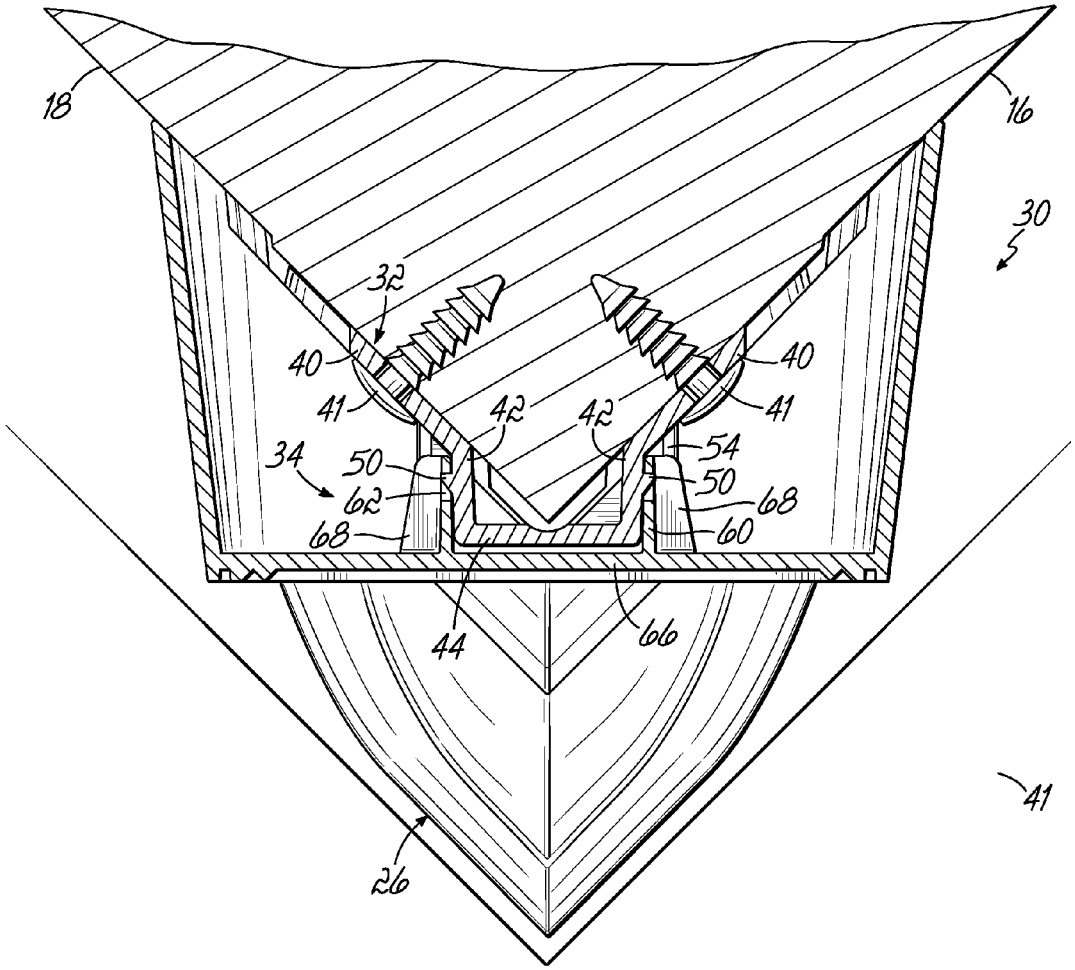
FIG. 4B is a view similar to FIG. 4A but with the ornamental corner attached to the attachment structure.
Figure 5:
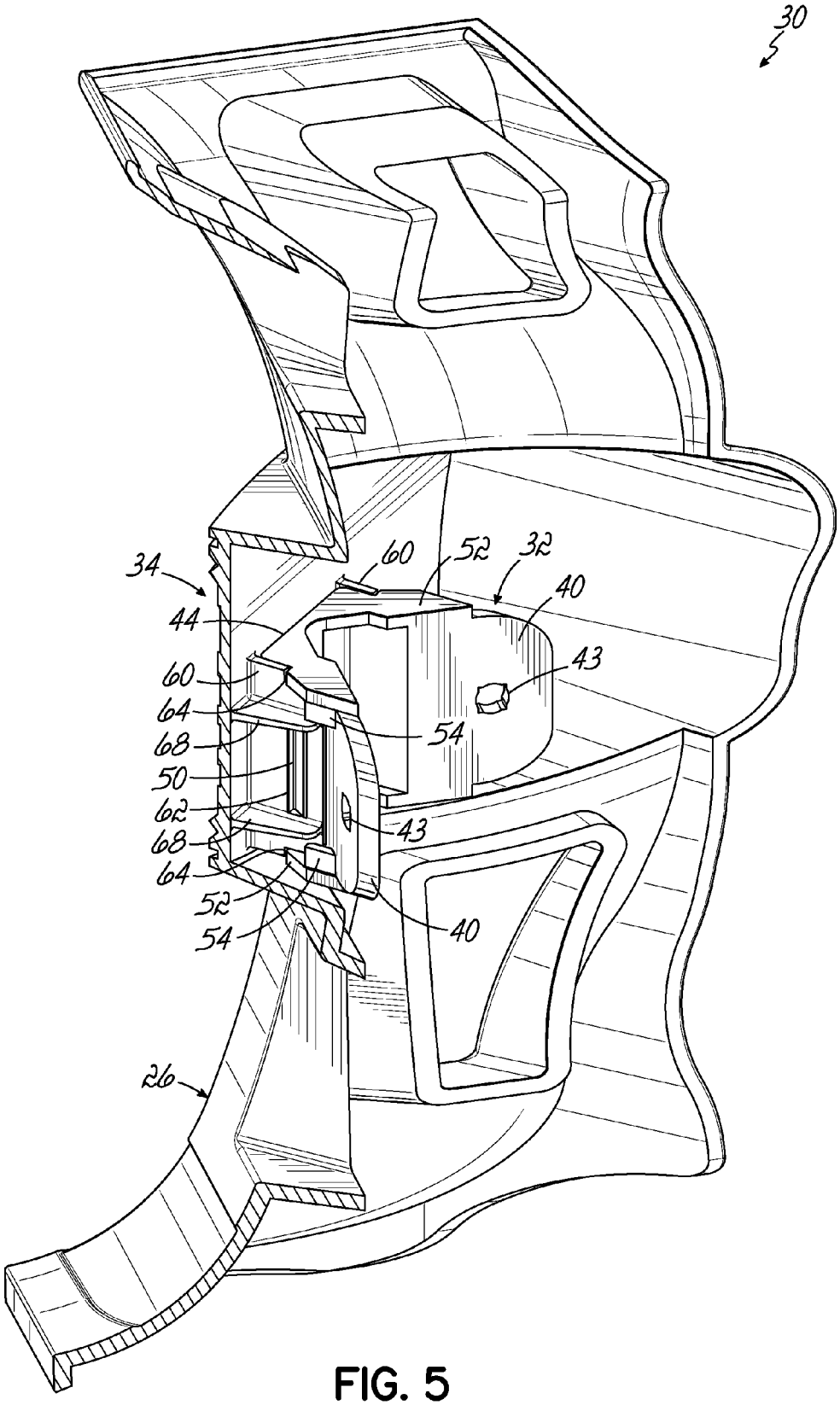
FIG. 5 is another partial rear perspective view of the ornamental corner and attachment structure of FIGS. 2, 3, 4A, and 4B.

Referring first to FIG. 1, there is illustrated a casket 10 embodying the principles of the present invention. The casket 10 includes a casket shell 12 and one or more casket lids or caps 14 closeable on the shell 12. The shell 12 includes a pair of side walls 16 and a pair of end walls 18 and handle bars 20 of the swing arm type. Each handle bar 20 is pivoted to the shell 12 by a number of swing arms 22. Each pivotal connection of a swing arm 22 to the shell side walls 16 is covered with a decorative ear or escutcheon 24. A decorative corner ornament 26 is attached to each corner of the shell 12 formed by the ends of adjacent ones of the side walls 16 and end walls 18 of the shell.

Referring now to FIGS. 2-5, the decorative corner ornament 26 and its attachment mechanism 30 attaching the decorative corner ornament 26 to the shell 12 is illustrated in more detail. The attachment mechanism 30 has a first portion 32 mounted to a corner of the shell 12 and a second portion 34 mounted to the casket ornament 26. More particularly, the first portion 32 can take the form of a pair of legs 40 oriented at about a 90 degree angle relative to one another, a pair of generally vertically oriented side walls 42, each side wall 42 oriented at about a 135 degree angle relative to its respective leg 40, and a front wall 44. Legs 40 can be fastened to the casket shell 12 side 16 and end 18 walls with plastic Christmas tree fasteners 41, for example. Other fasteners can also be used. Each side wall 42 has a generally vertically oriented rib 50 thereon. The first attachment mechanism portion 32 further includes two pairs of vertically spaced apart vertical locators 52, each pair associated with each respective leg 40 and side wall 42, preventing vertical movement of the attachment mechanism second portion 32 beyond a predetermined amount, and two pairs of vertically spaced apart horizontal locators 54, each pair also associated with each respective leg 40 and side wall 42, preventing horizontal movement of the attachment mechanism second portion 32 beyond a predetermined amount.

The second attachment mechanism portion 34 can take the form of a pair of generally vertically oriented side walls 60 each of which includes a generally vertically oriented slot 62 therein. The pair of attachment mechanism second portion 34 side walls 60 resiliently cooperate with the pair of attachment mechanism first portion 32 side walls 42 such that the ribs 50 are resiliently received in the slots 62. Each of an upper edge and a lower edge of each side wall 60 of the attachment mechanism second portion 34 includes a notch 64 therein receiving a respective one of the vertical locators 52 of the attachment mechanism first portion 32. The forward upper and lower portions of each side wall 60 of the attachment mechanism second portion are received between the horizontal locators 54 and their respective side wall 42 of the attachment mechanism first portion 32. The side walls 60 of attachment mechanism second portion 34 are cantilevered from a front wall 66 of the casket ornament 26, and are further connected to the front wall 66 of the casket ornament 26 with a pair of vertically spaced apart gussets 68. An upper gusset 68 of each pair of gussets 68 is positioned above an upper end of a respective one of the generally vertically oriented slots 62 and a lower gusset 68 of each pair of gussets 68 is positioned below a lower end of a respective one of the generally vertically oriented slots 62.

To enable resilient connection between the first 32 and second 34 portions of the attachment mechanism 30, the first 32 and second 34 portions of the attachment mechanism 30 can be fabricated of plastic, for example molded from plastic. Other resilient materials having a degree of flexibility could also be used. To simplify the manufacturing process, the casket ornament 26 and the attachment mechanism 30 could each be integrally molded from plastic. The ornament 26 and attachment mechanism 30 could be used on either wood caskets or sheet metal caskets.

To attach the ornament 26 to the casket shell 12, the first 32 and second 34 portions of the attachment mechanism 32 are aligned and the ornament 26 and first portion 32 are pressed forwardly onto second portion 34 causing ribs 50 to snap into slots 62. To remove the ornament 26 from the casket shell 12, the side walls 60 of second portion 34 are deflected slightly outwardly, which may require a tool, for example screw driver, causing ribs 50 to withdraw from slots 62.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. The invention resides in each individual feature described herein, alone, and in all combinations of any and all of those features. Departures may therefore be made from such details without departing from the spirit or scope of the general inventive concept. Accordingly, the scope of the invention shall be limited only by the following claims and their equivalents.

What is claimed is:

1. A casket comprising:

a casket shell adapted to receive a deceased, a casket lid closeable on said shell, a casket ornament, and an attachment mechanism, said attachment mechanism having a first portion mounted to a corner of said shell and a second portion mounted to said casket ornament, said first and second portions resiliently cooperating to operably removably attach said casket ornament to said casket shell corner, wherein said attachment mechanism first portion comprises:

a pair of legs oriented at about a 90 degree angle relative to one another, each of said pair of legs attached to a respective one of a side wall and an end wall of said casket shell, a pair of generally vertically oriented side walls each of which is associated with a respective one of said legs, each said side wall and said respective one of said legs oriented at about a 135 degree angle relative to one another, each said side wall including a generally vertically oriented rib thereon, wherein said attachment mechanism second portion comprises:

a pair of generally vertically oriented side walls each of which includes a generally vertically oriented slot therein;

said pair of attachment mechanism second portion side walls resiliently cooperating with said pair of attachment mechanism first portion side walls such that said ribs are received in said slots.

2. The casket of claim 1 wherein said attachment mechanism first portion includes a pair of vertically spaced apart vertical locators preventing vertical movement of said attachment mechanism second portion beyond a predetermined amount.

3. The casket of claim 2 wherein each said side wall of said attachment mechanism first portion includes a said pair of vertically spaced apart vertical locators.

4. The casket of claim 3 wherein each of an upper edge and a lower edge of each said side wall of said attachment mechanism second portion includes a notch therein receiving a respective one of said vertically spaced apart vertical locators.

5. The casket of claim 1 wherein said attachment mechanism first portion includes a horizontal locator horizontally spaced apart from one of said side walls of attachment mechanism first portion, said horizontal locator and said one side wall preventing horizontal movement of said attachment mechanism second portion beyond a predetermined amount.

6. The casket of claim 5 wherein each said side wall of said attachment mechanism first portion includes a pair of vertically spaced apart horizontal locators.

7. The casket of claim 1 wherein said side walls of said attachment mechanism first portion are connected with a front wall.

8. The casket of claim 1 wherein said side walls of said attachment mechanism second portion are cantilevered from a front wall of said casket ornament, and wherein each of said side walls of said attachment mechanism second portion are further connected to said front wall of said casket ornament with a pair of vertically spaced apart gussets.

9. The casket of claim 8 wherein an upper gusset of each said pair of gussets is positioned above an upper end of a respective one of said generally vertically oriented slots and a lower gusset of each said pair of gussets is positioned below a lower end of a respective one of said generally vertically oriented slots.

10. The casket of claim 1 wherein said first and second portions of said attachment mechanism are molded from plastic.

11. The casket of claim 10 wherein said casket ornament and said attachment mechanism second portion are integrally molded from plastic.

12. The casket of claim 11 wherein said legs of said attachment mechanism first portion are fastened to said casket shell side and end walls with plastic Christmas tree fasteners.

13. The casket of claim 12 wherein said casket is fabricated of wood.

14. The casket of claim 12 wherein said casket is fabricated of sheet metal.

* * * * *